US005346448A

United States Patent [19]

Sollo

[11] Patent Number: 5,346,448

[45] Date of Patent: Sep. 13, 1994

[54] FREE WEIGHT LIFTING SYSTEM

[76] Inventor: Robert E. Sollo, 1132 Ocean Ave., New London, Conn. 06320

[21] Appl. No.: 58,277

[22] Filed: May 4, 1993

[51] Int. Cl.[5] ..... A63B 21/078

[52] U.S. Cl. ..... 482/104; 482/99; 482/121; 482/130; 482/142

[58] Field of Search ..... 482/104, 121–130, 482/142, 99–108

[56] References Cited

U.S. PATENT DOCUMENTS

| | | | |
|---|---|---|---|
| 1,472,906 | 11/1923 | Gorrell . | |
| 2,960,701 | 11/1960 | Nawara . | |
| 3,524,644 | 8/1970 | Kane . | |
| 3,640,529 | 2/1972 | Kane . | |
| 3,659,844 | 5/1972 | Cummins . | |
| 3,904,198 | 9/1975 | Jones . | |
| 3,948,513 | 4/1976 | Pfotenhauer . | |
| 4,241,914 | 12/1980 | Bushnell . | |
| 4,262,901 | 4/1981 | Faust . | |
| 4,306,715 | 12/1981 | Sutherland | 482/104 |
| 4,382,596 | 5/1983 | Silberman . | |
| 4,598,908 | 7/1986 | Morgan . | |
| 4,618,142 | 10/1986 | Joseph, Jr. . | |
| 4,729,561 | 3/1988 | Desjardins | 482/104 |
| 4,781,374 | 11/1988 | Lederman | 482/104 X |
| 4,832,334 | 5/1989 | Mullen | 482/128 X |
| 4,934,693 | 6/1990 | Santoro | 482/104 X |
| 4,949,960 | 8/1990 | Harlan . | |
| 4,958,833 | 9/1990 | Stater | 482/104 |
| 4,974,839 | 12/1990 | Cantor | 482/104 |
| 5,082,260 | 1/1992 | Dinelli | 482/104 |
| 5,098,361 | 3/1992 | Danylieko . | |
| 5,162,031 | 11/1992 | Watson . | |

FOREIGN PATENT DOCUMENTS

| | | | |
|---|---|---|---|
| 456790 | 3/1928 | Fed. Rep. of Germany | 482/104 |
| 1443892 | 12/1988 | U.S.S.R. | 482/104 |

*Primary Examiner*—Robert Bahr

*Attorney, Agent, or Firm*—Albert W. Hilburger

[57] ABSTRACT

A free weight lifting system utilizes a lifting bar with an inboard region to be gripped by a weight lifter and opposed ends which can receive and support one or more weights to be lifted. A first pair of spaced apart upright members are positioned in a first longitudinally extending plane and a second pair of spaced apart upright members positioned in a second longitudinally extending plane, the first and second planes being spaced apart and generally parallel. A first yieldable cord extends between the first pair of upright members and a second yieldable cord extends between the second pair of upright members. In one mode of operation, the lifting bar is positioned beneath the elastic cords. When it is raised by the weight lifter, an upper surface of the bar is engageable with the yieldable cords at spaced locations such that progressively increasing resistance is imparted to the weight lifter. In another mode of operation, the lifting bar is positioned above the yieldable cords. When the bar is lowered by the weight lifter, a lower surface of the bar is engageable with the yieldable cords such that progressively increasing assistance is imparted to the weight lifter. In order to minimize friction between the bar and the cord during the lifting operation, rolling sleeves are provided on the bar which are engageable with the yieldable cords. The entire system may be size adjustable to accommodate all sizes of weight lifting equipment.

20 Claims, 3 Drawing Sheets

FIG. 3.
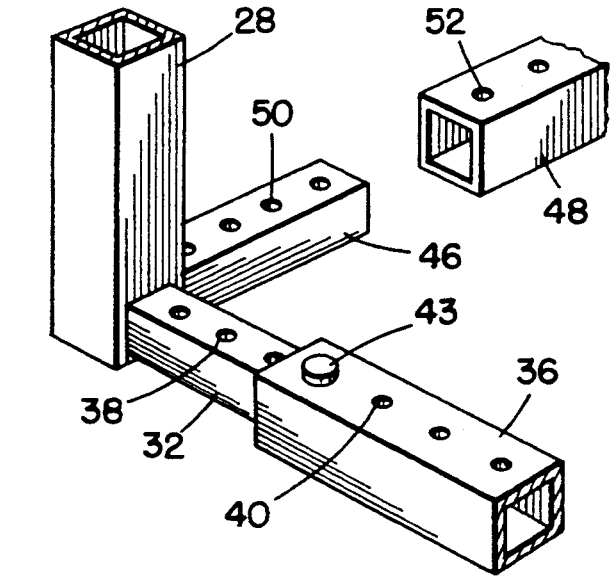
FIG. 7.
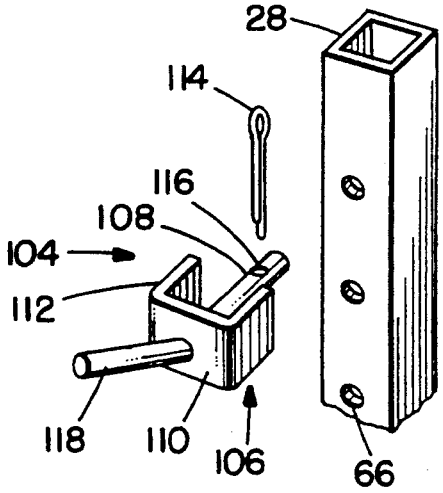
FIG. 5.
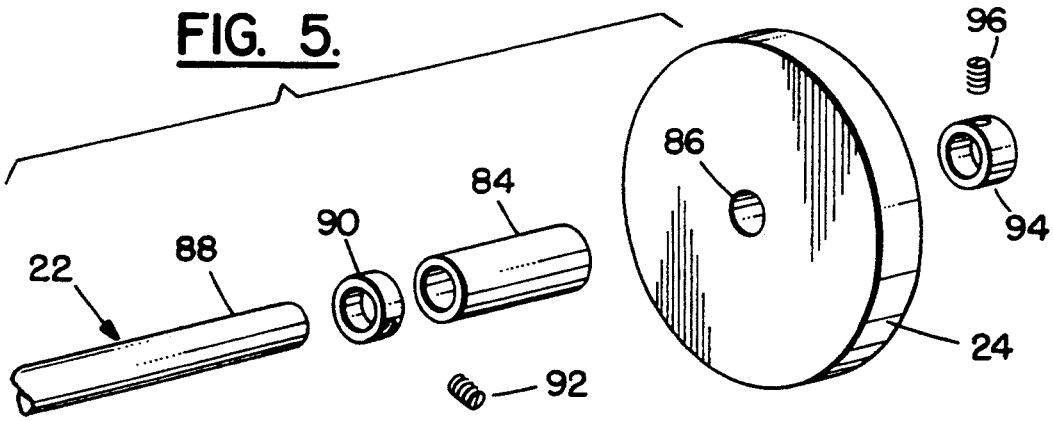
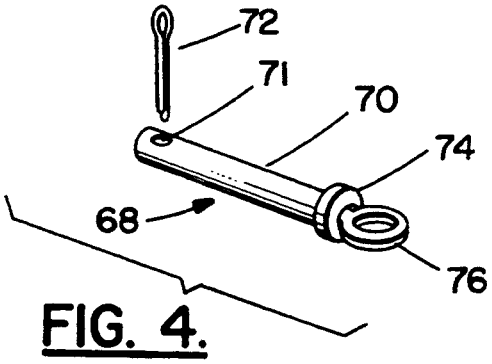
FIG. 4.

FREE WEIGHT LIFTING SYSTEM

BACKGROUND OF THE INVENTION

1. Field of the Invention

This invention relates generally to exercising apparatus for developing the human musculature and maintaining human physical fitness. More particularly, this invention relates to an apparatus which is highly versatile in the number and types of exercises which can be performed using it, which is fully portable, can be easily assembled and disassembled, and can be used safely.

2. Description of the Prior Art

It has been established beyond any serious argument that the human body should undergo a regular regimen of exercise in order to maintain a person's good physical and mental health and to afford proper muscular development. Disease of the cardiovascular system, for instance, poses a major health problem in the United States. Other health problems include those constituting a physical manifestation of conditions of mental stress such as frustration and worry incident to the strenuous pace of modern living. Another problem resides in the need to maintain a feeling and appearance of physical well-being. Physical exercise is often quite helpful in alleviating such problems. Exercise can maintain the human body trim and physically fit and can allow mental relaxation while a person is engaged in an enjoyable diversion which can provide an outlet for his frustrations.

In the not too distant past, rigorous physical exercise formed an inherent part of human life. The population of this country in particular was located largely in rural areas and the economy was predominantly agrarian. The farm work associated with earning a livelihood provided more than enough exercise and the life style was significantly more relaxed than under present circumstances. The urban population was quite centralized and most people could walk to work. Furthermore, once at work most people were engaged in largely stress free physical tasks which provided adequate exercise for general physical fitness.

With the advent of industrialization and automation, life has become increasingly sedentary. The rural segment of the population now constitutes only a fraction of the total and even farming activities have become highly mechanized. Urban centers have become quite large and people must now commute to work. Once at work, the activity in which they engage has become significantly more stressful and at the same time less physical. Furthermore, due to the more hectic pace of modern life and the fact that people must now commute to work, significantly less time is available for any extra physical exercise.

Nonetheless, in recognition of problems caused by a lack of physical exercise, many people have attempted self imposed regimens of physical exercise. These persons are often confronted with the problem that they lack the facilities or personnel to develop a satisfactory program of exercise. For instance, the absence of any suitable open and safe areas may render jogging impractical. Jogging may also be undesirable since it constitutes a relatively specialized activity. Swimming may be impractical because of its seasonal character in many parts of the United States and because of the need for a pool. Other activities such as team sports, of course, require a number of individuals. It may be impractical to convene such a group in light of busy and often conflicting schedules. Even activities such as tennis, squash, racket ball, or handball require at least one other person to provide a satisfactory regimen of exercise.

The problems suggested above have led some individuals to a regimen of exercise comprised of weight lifting.

Many weight lifting exercise machines have been developed and patented over the years. The goal of most of these machines is to provide safe and convenient exercise during which weights, which are either remotely located and operated by cables and pulleys or mounted locally as on a weight bar, are lifting against the force of gravity. These machines, with few exceptions, comprise a captive weight, or a weight that is supported in the machine in a manner that the user need exert a force only in a generally upward direction to perform the required exercise.

As a result, balance and coordination of effort by various muscles involved in the lifting process are not necessarily used when using such apparatus. Many weight lifters and bodybuilders are therefore returning to what is called "free-bar" exercises after having used such equipment. "Free-bar" exercises are those wherein the control and balancing of the weight is the total responsibility of the user. They have found that the exercise machines available to them are suitable for exercising the large muscles of the body but, because they do not require the user to control the weight in terms of balancing it, these machines fail to provide proper exercise for the finer muscles that are so important in balancing. One can readily imagine an athlete who has been trained exclusively on weight training machines having captive weights and who is therefore fully capable of lifting a weight, but is incapable of controlling the weight once it is lifted.

The weight lifting exercise known as the bench press requires a weight lifter to lie in a substantially supine position on a bench under a weight bar that carries a preselected amount of weight evenly distributed on the ends of the bar.

It should be understood that in most cases the bench is horizontal, although in some cases the bench or a part thereof may be inclined, usually with the user's head higher than his torso; in either case, the user's position is considered to be supine, by which reference both the horizontal and the inclined orientations are embraced. The weight bar is then lifted off the rack (attached to the bench at nearly the full extension of the user's arms) and brought down to the user's chest. The exercise then comprises lifting the weight from the chest to the full extension of the arms and returning it to the chest, and then repeating this procedure for an appropriate number of times.

At the completion of a period of exercising, the user must again lift the weight bar to the full extension of his arms to return the weight bar to the rack. Obviously, when the user is fatigued, as is often the case when the user has forced himself to perform more repetitions than he felt was his capacity, which technique is commonly called "overloading," the return of the weight bar to the rack is difficult or even dangerous.

Although weight lifters and bodybuilders know that safety should be of primary concern and that a second person should be ready to help or to remove the weight bar when such help is needed, the pressures of time and the availability of equipment for exercising lead them to ignore this important safeguard. Even when the safeguard is observed, injury can occur if the second person, the "spotter," takes inappropriate or unexpected action in his efforts to provided help to the exerciser.

Recent developments in the art of bodybuilding teach that greater effectiveness is obtained by exercising in the so-called "eccentric contraction" mode. To adherents of the eccentric contraction method, lifting the weight bar against the pull of gravity is considered less effective in building or developing muscle tissue than is lowering the weight from the initial full extension to the contracted position wherein, for the bench press, the weight bar is near the chest.

The adherents of the eccentric contraction mode would prefer to have aid from a source other than the muscle group being exercised to lift the weight; they then exercise the desired muscle group primarily during the slow lowering of the weight bar. When a spotter is used to accomplish this mode of exercise, the transfer of the weight bar from the user to the spotter and back again while it is always positioned above the user's reclining body, carries obvious hazards with respect to timing and coordination of the efforts of the two people to prevent the heavily-weighted bar from being dropped, causing serious injury to the user.

From the standpoint of time utilization, it would be desirable to have equipment that would make the bench press exercises described herein suitable to be performed by a solitary user without a spotter, even for the adherents of eccentric contraction or users of forced repetitions, while at the same time improving the safety of the exercise.

Typical of the prior art are the U.S. Pat. Nos. 4,598,908 to Morgan and 4,382,596 to Silberman which disclose versatile exercising apparatus which enables a user to perform a wide variety of weight training exercises. An exercise bar is disclosed in U.S. Pat. No. 3,904,198 to Jones which includes a pair of independent shafts which extend transversely thereof. Various sized weights can be supported on independent shafts and a pair of freely rotatable hand grips are positioned on the bar between the independent shafts. In U.S. Pat. Nos. 3,640,529 and 3,524,644, both to Kane, exercising apparatus for bar-bell type exercises provides assistance or resistance to the user, as desired. Another patent which discloses exercising apparatus providing either assistance or resistance to a user is U.S. Pat. No. 4,241,914 to Bushnell. In this instance, the apparatus comprises a frame and an elastic elongate member attached at opposite ends to the frame. The elastic member assists the user when it is downwardly deflected by the user's body and resists the user when it is upwardly deflected by the user's body.

SUMMARY OF THE INVENTION

It was with knowledge of the prior art as just described that the present invention was conceived and has now been reduced to practice. The present invention relates to a free weight lifting system which utilizes a lifting bar with an inboard region to be gripped by a weight lifter and opposed ends which can receive and support one or more weights to be lifted. A first pair of spaced apart upright members are positioned in a first plane and a second pair of spaced apart upright members positioned in a second plane, the first and second planes being spaced apart and generally parallel. A first yieldable cord extends between the first pair of upright members and a second yieldable cord extends between the second pair of upright members. In one mode of operation, the lifting bar is positioned beneath the yieldable cords. When it is raised by the weight lifter, an upper surface of the bar is engageable with the elastic cords at spaced locations such that progressively increasing resistance is imparted to the weight lifter. In another mode of operation, the lifting bar is positioned above the yieldable cords. When the bar is lowered by the weight lifter, a lower surface of the bar is engageable with the yieldable cords such that progressively increasing assistance is imparted to the weight lifter. In order to minimize friction between the bar and the cord during the lifting operation, rolling sleeves are provided on the bar which are engageable with the yieldable cords. The entire system may be size adjustable to accommodate all sizes of weight lifting equipment.

The concept of assistance/resistance in weight training fostered by the present invention is not new. Personal trainers and workout partners provide the assistance when spotting the lifter. Resistance is provided when trainers or partners place resistance on the bar when a lift is in progress. These concepts of assistance/resistance provide the lifter with a different type of muscle fatigue than that to which the lifter is accustomed. Thus growth is promoted through the use of these activities. Specialized equipment designed to allow the lifter to work a specific range of motion have previously been available but has not usually been affordable for the average home lifter. Equipment manufacturers have sought for years to simulate the assistance/resistance provided by trainers and partners. The success of these ventures has resulted in some very elaborate systems designed to assist the lifter in his/her progress toward physical achievement. At the present time, few of these systems are affordable for the average lifter. The present invention attempts to bridge the gap between technology availability and practical affordability. This system not only provides assistance and resistance but provides it in a progressive or regressive fashion when the lifter needs it most. For assistance, the invention provides most of its assistance at the bottom of the lift and decreases that assistance as the lift progresses. For resistance, it allows the lifter to start with no resistance and progressively increases resistance to the top of the movement. Combined with safety bars which would be standard with each weight lifting unit, the unique system of the invention provides the average home lifter with the assistance needed to continue to make progress and the safety to allow a feeling of confidence that he or she will not get hurt.

Accordingly, a primary object of the present invention is to provide a free weight lifting system which can selectively provide assistance or resistance to a lifter.

Another object of the present invention is a free weight lifting system which is readily adjustable in size to accommodate a wide range of sizes of lifting equipment.

A further object of the present invention is to provide a free weight lifting system which provides utmost safety for lifters in all regimes of lifting.

Still another object of the invention is to provide a free weight lifting system which is of simplified design, utilizes commonly available materials in its construction, and can be readily assembled and disassembled.

Yet a further object of the present invention is to provide a free weight lifting system with all of the above mentioned features which is affordable by nearly all lifters.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate some of the embodiments of the invention, and together with the description, serve to explain the principles of the invention in general terms. Like numerals refer to like parts throughout the disclosure.

BRIEF DESCRIPTION OF THE DRAWINGS

FIG. 3 is a detail perspective exploded view, partly cut away and in section, illustrating a part of the system of FIGS. 1 and 2;

FIG. 4 is a detail perspective view of a component of the system of FIGS. 1 and 2;

FIG. 5 is a detail perspective exploded view of other components illustrated in FIGS. 1 and 2;

FIG. 7 is a detail perspective exploded view of still other components of the system illustrated in FIGS. 1 and 2;

DETAILED DESCRIPTION OF THE PREFERRED EMBODIMENT

Figure 1:
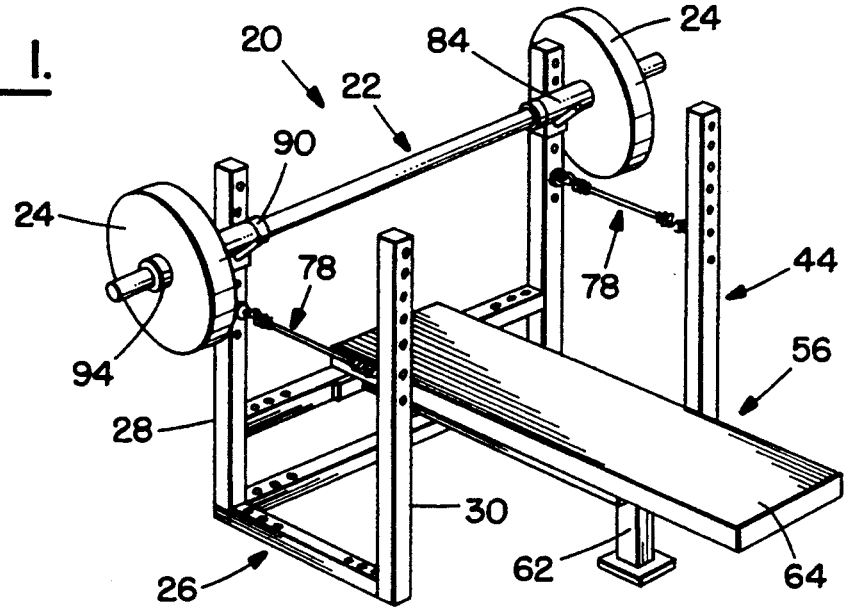
FIG. 1 is a perspective view of a free weight lifting system embodying the present invention.

Turn now to the drawings and, initially, to FIG. 1 which generally illustrates a free weight lifting system 20 embodying the present invention. Free weight lifting is a mode of weight lifting by reason of which the lifting bar and its supported weights are substantially free of mechanisms which generally guide and sometimes partially support the weights being lifted. Hence, the present invention relates to a mode of lifting which is significantly different from that espoused by those systems bearing the "NAUTILUS" trademark, and other similar systems.

To this end, the system 20 utilizes an elongated lifting bar 22 to the opposite ends of which are suitably mounted appropriate weights 24 to be lifted. In typical fashion, the lifter lifts the bar 22 by gripping its inboard regions, that is, intermediate the weights 24.

A left hand support 26 includes a pair of spaced apart upright members, specifically, a fore upright member 28 and an aft upright member 30. Viewing FIG. 2 which illustrates the lifting system 20 in greater detail, with the exception of the lifting bar 22, it is seen that the upright member 28 has an integral longitudinal beam member 32 extending in the direction of the upright member 30. Oppositely, a longitudinal beam member 34, integral with the aft upright member 30, extends longitudinally in the direction of the fore upright member 28. An elongated connection member 36 may be of hollow construction to telescopingly receive the beam members 32, 34 through its associated open ends.

Figure 2:
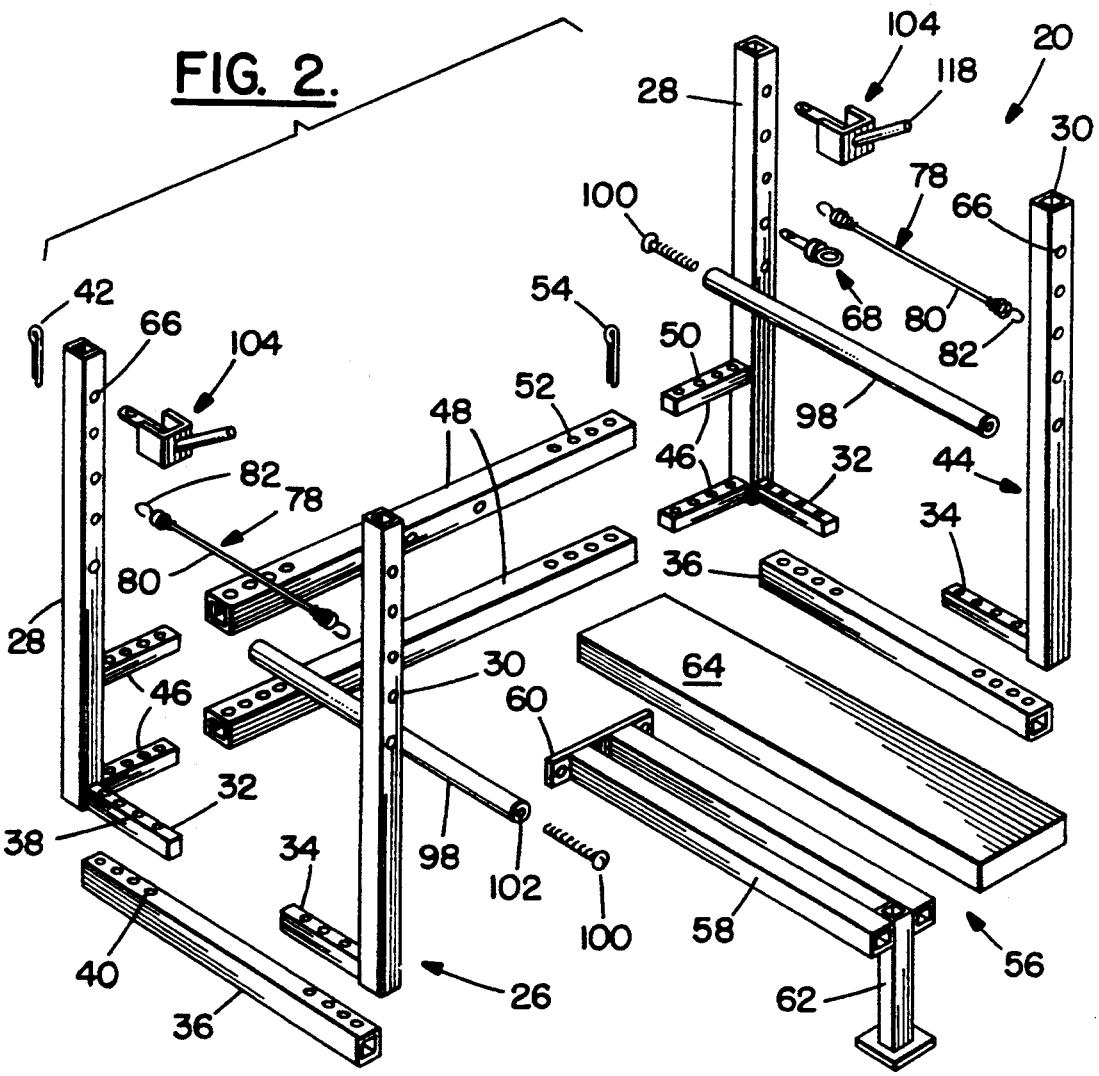
FIG. 2 is a perspective exploded view of the free weight lifting system illustrated in FIG. 1.

The beam members 32, 34 are formed with a plurality of longitudinally spaced mounting holes 38 and the connection member 36 is similarly provided with a plurality of longitudinally spaced mounting holes 40. When a desired length is achieved for the left hand support 26, suitable fasteners 42 may be inserted through corresponding mounting holes 40 in the connection members 36 and mounting holes 38 in the beam members 32, 34 once a desired length of the left hand support 26 has been achieved. Although fasteners 42 are depicted in FIG. 2 to be nature of cotter pins, they may, in fact, be of any form which is suitable for the purpose. For example, they may be in the nature of fasteners 43 (see FIG. 3) with broad heads and depending shanks (not shown) which extend through the mounting holes 38, 40.

A right hand support 44 is generally of a construction which is similar to that of the left hand support 26. Therefore, it is considered that the description just provided for the left hand support 26 will suffice for the right hand support 44.

Even as the beam members 32, 34 and their associated connection member 36 enable longitudinal adjustment of the system 20, a similar form of adjustment is provided in a lateral direction, that is, transverse of the parallel planes containing the left hand support 26 and the right hand support 44. Specifically, each of the fore upright members 28 of the supports 26, 44 has at least one integral cross beam member 46 which extends transversely, that is, laterally, in the direction of the opposite support. Again, a hollow connection member 48, open at both ends, is provided for slidable reception therein of the cross beam members 46. As with the beam members 32, 34, the cross beam members 46 are provided with a plurality of laterally spaced mounting holes 50 which cooperate with laterally spaced mounting holes 52 on the connection member 48 to achieve a desired width dimension for the system 20. When appropriate holes 50, 52 have been aligned, suitable fasteners 54 are inserted through the mounting holes 50, 52 to maintain the width dimension until it is desirably changed at some future time.

As illustrated in FIGS. 1 and 2, a bench 56 may be provided as part of the system 20, although it is not necessary for the purposes of the invention. As illustrated, the bench 56 includes a horizontal structure 58 which terminates at a forward bracket 60 which may be suitably fastened to an elevated connection member 48. The opposite end of the horizontal structure 58 is mounted on a post 62 which extends to the floor. Overlying and suitably attached to the horizontal structure 58 is a platform 64 on which the lifter lies.

Both the fore upright members 28 and the aft upright members 30 are formed with a plurality of longitudinally extending mounting bores 66 at vertically spaced locations. Associated pairs of mounting bores 66 on each of the upright members 28, 30 are at similar heights so that a line drawn between them would be substantially horizontal.

Mounting ring members 68 (see especially FIG. 4) have an elongated shank 70 which is slidably receivable through each of the mounting bores 66. A hole 71 adjacent one end of a mounting ring member 68 serves to receive a suitable fastener 72, such as a cotter pin, and the other end of each ring member 68 has a shoulder 74 to bear against its associated upright member 28, 30 and terminates at a hook receiving ring 76.

With mounting ring members 68 thereby attached, respectively, to fore and aft upright members 28, 30 of supports 26 and 44, elastic cord members 78 may be stretched between the opposed ring members 68 and attached to them. Specifically, each elastic cord member 78 may be, for example, in the nature of a bungee cord having an elastic mid section 80 and terminated at its opposite ends with hooks 82. Thus, each hook 82 of an elastic cord member 78 is engaged with a ring 76 of an associated mounting ring member 68. It will be appreciated that while it is desirable for the mounting ring members 68 to be placed in mounting bores 68 of the fore upright members 28 so that they lie in the same horizontal plane and, similarly, with respect to the aft upright members, it may be desirable to mount them in different planes from the fore upright members to the aft upright members. The reason for this recommended placement will be explained below.

Figure 6:
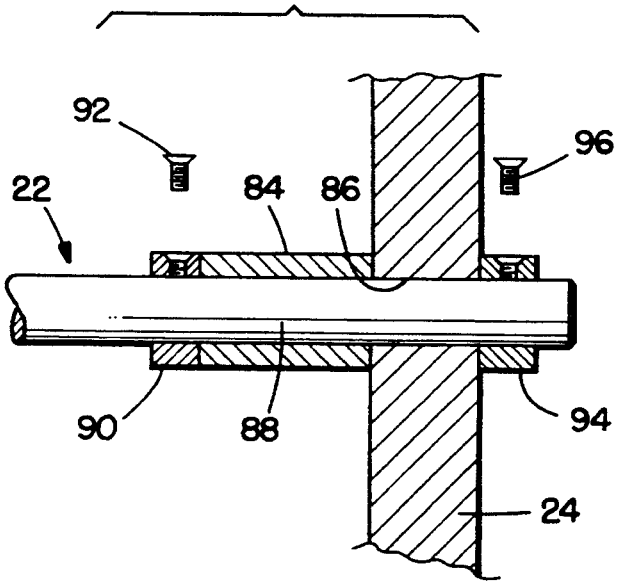
FIG. 6 is a detail elevation view, in section, of the components illustrated in FIG. 5.

It was earlier mentioned that the lifting bar 22 is provided with dual weights 24 adjacent its ends. As seen in FIG. 1, the lifting bar 22 extends generally transverse of planes containing the supports 26, 44. The lifting bar 22 is modified from conventional lifting bars in having a pair of sleeve members 84 which are rotatable on the bar 22 and generally aligned with the elastic cord members 78. In a typical conventional construction, although many other construction may be contemplated, the weights 24 are provided with a central bore 86 (FIGS. 5 and 6) for journaled reception on an end 88 of the lifting bar 22. See FIG. 5. However, according to the invention, the sleeve 84 is slidably received on the end 88 of the lifting bar 22 such that an outboard end of the sleeve is proximate to the weight. In turn, a restraint collar 90 is releaseably fixed to the bar 22 as by a set screw 92 and is adjacent an inboard end of the sleeve member 84. A second restraint collar 94 is then received on the lifting bar 22 adjacent the outboard side of the lifting weight 24 and a set screw 96 serves to releaseably hold the restraint collar 94 in place. There is sufficient clearance between the ends of the sleeve member 84 and the restraint collar 90 and the weight 24 to enable the sleeve member to rotate freely relative to the lifting bar 22.

Because the sleeve members 84 are generally aligned with their associated elastic cord members 78, they will be caused to rotate freely when engaged by the elastic cord members and the lifting bar will not tend to rotate out of the grip of the lifter which might otherwise occur in the absence of the sleeve members.

Whenever lifting is performed, it is desirable, even necessary, to provide protection for the lifter against an accident. For this reason, viewing FIG. 2, a pair of rigid safety rods 98 are desirably provided. These rods are intended to extend in a longitudinal direction between respective upright members 28, 30. In this regard, a safety rod 98 is aligned with opposed mounting bores 66 in the upright members 28, 30 and a suitable fastener such as a bolt 100 extends through the associated bore of each upright member and is threadedly engaged with a tapped bore 102 in the safety rod 98. In view of the fact that the supports 26 and 44 are longitudinally extendable, it may be necessary to have a set of safety rods 98, one for each incremental length of the supports.

It is also desirable to temporarily support the lifting bar 22 on the system 20 between lifts. A pair of brackets 104 (see especially FIGS. 2 and 7) may be provided for this purpose. Each bracket member 104 includes a 3 sided base member 106 intended for snug reception with the outer surface of the upright members 28. A pin member 108 integral with a bight portion 110 of the base member extends away therefrom in a direction generally parallel to opposed ears 112 of the base member. The pin member 108 is intended for reception through an associated one of the mounting bores 66 in each of the upright members 28. When the bracket member 104 is fully attached to the upright member 28, a free end of the pin member 108 projects through the upright member 28 enabling a fastener, such as a cotter pin 114, to be inserted through a hole 116 in the pin member 108 to thereby retain the bracket member in place. A peg 118 is integral with the bight portion of 110 and projects away from the base member 106 in a direction opposite the pin member 108, but upwardly, and serves to engageably receive the lifting bar. As seen in FIGS. 1 and 2, a pair of the bracket members 104 is suitably attached to the upright members 28 in the same plane so as to hold the lifting bar 22 in a substantially horizontal position. Also, it will be appreciated that the bracket members 104 can be placed at any of the elevations provided by the mounting bores 66 according to the desire of the lifter.

For optimum lifting, the bar 22 should be raised in a path which is anatomically correct for the particular lifter. A common tendency of new lifters is to lift outside of that path. The invention aids lifters in achieving the proper path of travel of the bar for a particular exercise. By manipulating the position of the cord members 78 fore and aft, that is, as it stretches between the upright members 28, 30, an arc of assistance is imparted to the lifter based on his or her personal desires.

Flat bench operation requires that the mounting ring members 68 be placed in such a manner that the cord members 78 are positioned horizontal to the floor. The mounting ring members should be placed high on the uprights, but below the level of the bracket member 104. The higher the ring members 68 are placed, the more range of assistance the lifter will experience. Of course, before the lifter removes the bar 22 from the bracket members 104, the safety rods 98 should be properly secured to assure the safety of the lifter in the event grip on the bar is lost or the weights 24 become overpowering.

Figure 8A:
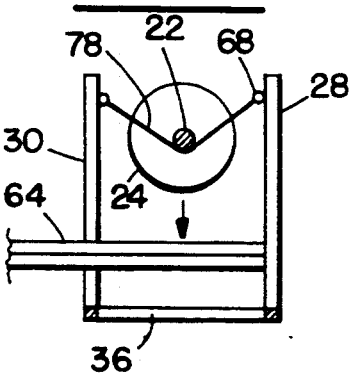
FIGS. 8A, 8B, 8C, and 8D are side elevation diagrammatic views illustrating different modes of operation of the system of the invention.

As seen in FIG. 8A, with the lifter lying on the bench, he grips the bar 22, lifts it off the bracket members 104 (FIGS. 2 and 7) and begins a downward movement. As the bar descends, the sleeve members 84 are caused to engage the cord members 78. Any relative movement between the cord members and the lifting bar is accommodated by rotation of the sleeve members 84 on the bar. The cord members 78 will begin to stretch and will continue to stretch until the bottom of the lift is reached. Thereupon, the lifter starts a pressing movement in the normal manner. The stretched cord members 78 now serve to assist the lifter as the press is initiated. It will be understood that the elastic cord members are not intended as replacement for the lifter's own strength and are not intended to assist through the entire range of motion. Rather, the assistance becomes progressively less as the bar is raised until, eventually, the bar is raised off the cord members and the lifter bears the entire weight of the bar and weights without assistance.

It will be appreciated that the height of the cord members 78 is dependent upon the needs of the individual lifter. Also, if a lifter requires more assistance only on the bottom of the lift, the cord members would be placed at a lower level and if assistance is needed through mid range but not at an extreme position, an intermediate height could be chosen.

Figure 8B:
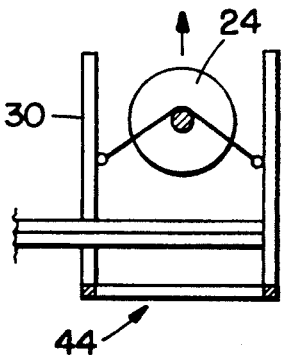

In an opposite manner, turning to FIG. 8B, lock out resistance may be used by lifters to overcome "sticking" points in a lifter's movement. For a bench press, these sticking points vary from the bottom (chest related) to mid range (shoulder related) to lock out position (triceps related). In this instance, the safety rods 98 are installed in a position to allow the lifting bar 22 to rest on the safety bars and not on the chest of the lifter. Then, the cord members 78 are positioned so that they overlie the bar 22. The height of the safety rods 98 above the lifter's chest depends on the specific sticking point being targeted. The safety rods would be placed low for chest development, mid range for shoulder development, or high for triceps development. For lock out resistance, the mounting ring members 68 will be placed just above the safety rods effectively pinning the lifting bar 22 between the safety rods and the cord members when they are installed.

According to one alternate operation of the system 20, more than one cord member 78 might be used with each of the supports 26, 44 thereby allowing extreme overload of the bar or providing extra resistance for training purposes. Another alternative operation of the system would be to employ a second set of cord members 78 installed at a different height than a first set to provide more assistance or resistance as the lift progresses.

Figure 8C:
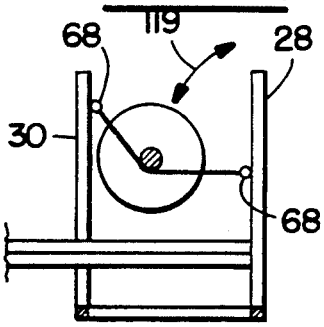

If a lifter is new to benching and is not familiar with the normal movement of the bar 22 in the course of a press, it may be desirable to use a slightly different placement for the cord members 78. For purposes of illustration, the mounting ring members 68 attached to the uprights 28 will be referred to as the forward ring members and the ones attached to the uprights 30 will be referred to as the aft ring members. For a new lifter, it is recommended that the aft ring members be placed substantially even with the bar when it is held at full extension and that the forward ring members should be placed two or three positions below the aft ring members. For example, viewing FIG. 8C, it will be appreciated that during a normal bench attempt, the bar should be over the lifter's upper aft and neck area at full extension. As the bar moves downward, as indicated by double arrowhead 119, in a manner indicated in FIG. 8C, it should arc downward toward the center or lower aft, although the particular lower position varies with individual lifters. As the bar is lifted, it should move in a smooth arc back toward the forward of the lifter until it reaches the original extended position. The placement of the mounting ring members 68 as depicted in FIG. 8C thus properly positions the cord member 78 so that the cord will assist in lifting and aid in imparting a proper arc of movement for the bar 22 in the lift.

Figure 8D:
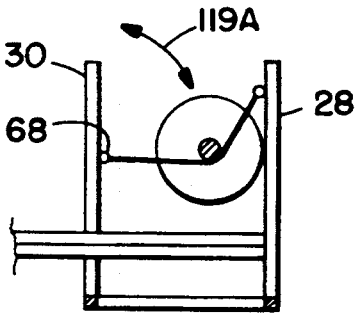

Alternatively, as seen in FIG. 8D, the forward ring members 68 may be placed higher than the aft ring members. This placement alters the direction of assistance provided to the lifter and aids in imparting an arc of movement in the lift, as indicated by double arrowhead 119A such that the movement helps prevent premature shoulder rotation. Without this assistance, such premature shoulder rotation would take the lift out of the desired path.

Up until this point, the cord members 78 have been described as being of a stretchable construction, as in the nature of a bungee cord. However, other constructions are possible while remaining within the scope of the invention. Turn now to FIGS. 9A and 9B for a description of such another possible construction. In this instance, an elongated cord 120 of substantially nonstretchable variety extends from a suitable ring member 68 to a platform 122 to which a plurality of weights 124 can be suitably mounted. With initial reference to FIG. 9A, the mounting ring members 68 would be placed at a preferred height on associated upright member 30 as previously described. A plurality of pulleys 126, 128, 130 are suitably mounted on each of the upright members 28. When in the rest condition, the cord 120 engages the pulleys 128,130, the latter pulley being positioned to hold the weights 124 away from contact with the upright member 28.

Figure 9A:
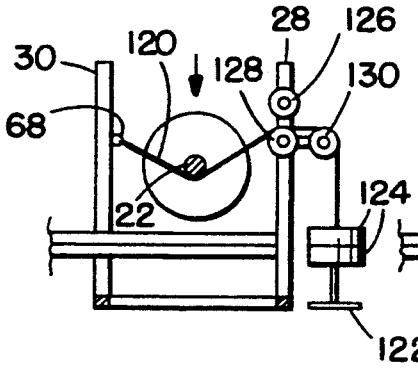
FIGS. 9A and 9B are side elevation diagrammatic views, similar to FIGS. 8A–8D, illustrating another construction of the invention.

When the lifter is in the assistance mode of lifting, as seen in FIG. 9A, the bar 22 engages the cord 120 and the weights 124 impart tension to the cord 120 thereby providing assistance to the lifter as the lockout position of the lift is approached.

Figure 9B:
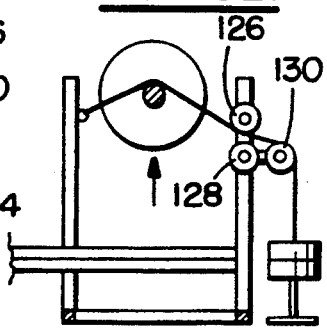

When the lifter is in the resistance mode of lifting, as seen in FIG. 9B, the cord 120 moves out of engagement with the pulley 128 and into engagement with the pulley 126. The pulleys minimize frictional losses in the system and provide a smooth mode of operation for the system 20.

By reason of invention, the assistance and/or resistance imparted to the lifting bar 22 by either the cord member 78 or the cord 120 varies in proportion to the position of the bar at any given time during the course of the lift. In addition, as seen with reference to FIGS. 8A through 8D, the path of travel for the bar can be varied according the type of training sought by the lifter. With proper positioning of the mounting ring members 68, the lifter will be forced to learn the correct path of travel for a lift. When correctly positioned, the cord members will gently push or pull the bar in the correct path for the desired movement.

Furthermore, by reason of the sleeve members 84, the invention enables a lifter to firmly grip the lifting bar 22 and this grip remains firm even when the bar moves into engagement with the cord members. In previously known bar constructions, engagement of the bar with a cord member tended to roll the bar out of the hands of the lifter. However by reason of the present invention, all that happens is that the sleeve members 84 rotate freely on the bar 22 and have no adverse effect on the grip of the lifter. This same feature also reduces wear on the cord members.

The system of the invention is safe for all users, instills confidence in a lifter, provides stability to a lifter whose press would otherwise be unstable and facilitates strengthening of muscles on a weaker side of the body when muscle strength is asymmetrical.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A free weight lifting system comprising:

spaced apart support means;

elongated lifting bar means for lifting by a weight lifter, said lifting bar means being detached from said support means and freely movable relative to said support means, said lifting bar means having upper and lower surfaces and opposed ends for selectively receiving and supporting weights to be lifted and an inboard region to be gripped by the weight lifter; and a pair of generally parallel spaced apart yieldable cord means having opposed ends removably fixed to and extending between said spaced apart support means and selectively engageable in one instance by said upper surface at spaced locations for imparting progressively increasing resistance to the weight lifter as said lifting bar means is raised into engagement therewith by the weight lifter;

said yieldable cord means being selectively engageable in another instance by said lower surface at spaced locations for imparting progressively increasing assistance to the weight lifter as said lifting bar means is lowered into engagement therewith by the weight lifter.

2. A free weight lifting system as set forth in claim 1 wherein said support means includes:

a pair of laterally spaced apart fore upright members each having an outer peripheral surface and a plurality of mounting bores therethrough at vertically spaced locations;

bracket means removably attachable to the mounting bores in each of said fore upright members for engageably receiving said lifting bar for support thereon.

3. A free weight lifting system as set forth in claim 2 wherein each of said bracket means includes:

a base member for fitting reception on said outer peripheral surface of said associated one of said fore upright members;

a pin member integral with said base member for reception through an associated one of the mounting bores; and a peg integral with said base member for engageably receiving said lifting bar thereon.

4. A free weight lifting system comprising:

elongated lifting bar means having upper and lower surfaces and opposed ends for selectively receiving and supporting weights to be lifted and an inboard region to be gripped by the weight lifter;

support means including:

a first pair of spaced apart upright members positioned in a first longitudinally extending plane; and a second pair of spaced apart upright members positioned in a second longitudinally extending plane, said first and second longitudinally extending planes being laterally spaced apart and generally parallel; and yieldable means mounted on said support means, said yieldable means including:

first elastic cord means extending between said first pair of upright members; and second elastic cord means extending between said second pair of upright members;

said first and second elastic cord means being selectively engageable in one instance by said upper surface at spaced locations for imparting progressively increasing resistance to the weight lifter as said lifting bar means is raised by the weight lifter;

said first and second elastic cord means being selectively engageable in another instance by said lower surface at spaced locations for imparting progressively increasing assistance to the weight lifter as said lifting bar means is lowered by the weight lifter.

5. A free weight lifting system as set forth in claim 4 wherein said lifting bar means has opposed ends and extends generally transverse of said first and second longitudinally extending planes and includes:

rolling means engageable with said elastic cord means for minimizing the effect of friction between said elastic cord means and said lifting bar means when engagement occurs.

6. A free weight lifting system as set forth in claim 5 wherein said lifting bar means includes a cylindrical bar having an outer peripheral surface; and wherein said rolling means includes:

a pair of cylindrical sleeve means rotatably mounted on said bar at spaced apart locations so as to be aligned with and engageable by said elastic cords upon operation of said lifting bar means by the weight lifter.

7. A free weight lifting system as set forth in claim 5 wherein said lifting bar means includes weight means releasably mounted proximate each of said opposed ends, respectively; and wherein each cylindrical sleeve means includes:

a sleeve member having inboard and outboard ends rotatably mounted on said bar, said outboard end being proximate said weight means; and a collar releasably fixed to said bar adjacent said inboard end of said sleeve member.

8. A free weight lifting system as set forth in claim 4 including bench means for supporting the weight lifter, said bench means being positioned generally parallel with and intermediate said first and second logitudinally extending planes.

9. A free weight lifting system as set forth in claim 4 wherein each of said first and second pairs of upright members includes a fore upright member and an aft upright member; and wherein each of said fore and aft members has attachment means at a plurality of vertically spaced locations; and wherein each of said first and second elastic cord means includes:

an elongated elastic member having opposed ends and including attachment means at said opposed ends;

a mounting member fixed to each of said opposed ends, each of said mounting members being selectively attachable to an associated one of said attachment means on said fore and aft members.

10. A free weight lifting system as set forth in claim 4 wherein each of said first and second pairs of upright members includes a fore upright member and an aft upright member; and wherein each of said fore and aft members has a plurality of mounting bores therethrough at vertically spaced locations; and wherein said support means includes mounting ring members selectively receivable in one of the mounting bores; and wherein each of said first and second elastic cord means includes:

an elongated elastic member having opposed ends;

a mounting hook member fixed to each of said opposed ends, each of said mounting hook members being selectively attachable to one of the mounting ring members.

11. A free weight lifting system as set forth in claim 4 wherein said support means includes:

width adjustment means for selectively adjusting the separation between said first and second planes; and length adjustment means for selectively adjusting the separation between said first and second pairs of upright members.

12. A free weight lifting system as set forth in claim 11 wherein each of said first and second pairs of upright members includes a fore upright member; and wherein said width adjustment means includes:

at least one first cross beam member integral with said fore upright member of said first pair of upright members and extending transversely thereof in the direction of said second pair of upright members;

at least one second cross beam member integral with said fore upright member of said second pair of upright members and extending transversely thereof in the direction of said first pair of upright members; and lateral connection means for selectively joining said first and said second cross beam members at any one of a plurality of locations corresponding to a desired width between said first and second planes.

13. A free weight lifting system as set forth in claim 11 wherein each of said first and second pairs of upright members includes a fore upright member; and wherein said width adjustment means includes:

at least one first cross beam member integral with said fore upright member of said first pair of upright members and extending transversely thereof in the direction of said second pair of upright members, said first cross beam member having a plurality of transversely spaced holes therein;

at least one second cross beam member integral with said fore upright member of said second pair of upright members and extending transversely thereof in the direction of said first pair of upright members, said second cross beam member having a plurality of transversely spaced holes therein; and fastener means receivable through respective aligned transversely spaced holes in said first and second cross beam members for selectively joining said first and said second cross beam members at any one of a plurality of locations corresponding to a desired width between said first and second planes.

14. A free weight lifting system as set forth in claim 11 wherein each of said first and second pairs of upright members includes a fore upright member and an aft upright member; and wherein said length adjustment means includes:

for each of said first and second pairs of upright members, at least one first longitudinal beam member integral with said fore upright member and extending longitudinally thereof in the direction of said aft upright member, said first longitudinal beam member having a plurality of longitudinally spaced holes therein;

and at least one second longitudinal beam member integral with said aft upright member and extending longitudinally thereof in the direction of said fore upright member, said second longitudinal beam member having a plurality of longitudinally spaced holes therein; and fastener means receivable through respective aligned longitudinally spaced holes in said first and second longitudinal beam members for selectively joining said first and said second longitudinal beam members at any one of a plurality of locations corresponding to a desired spacing between said fore and aft members.

15. A free weight lifting system as set forth in claim 4 wherein said support means includes:

wherein each of said first and second pairs of upright members includes a fore upright member and an aft upright member; and wherein said length adjustment means includes:

for each of said first and second pairs of upright members, at least one first longitudinal beam member integral with said fore upright member and extending longitudinally thereof in the direction of said aft upright member and at least one second longitudinal beam member integral with said aft upright member and extending longitudinally thereof in the direction of said fore upright member; and longitudinal connection means for selectively joining said first and said second longitudinal beam members at any one of a plurality of locations corresponding to a desired spacing between said fore and said aft upright members.

16. A free weight lifting system as set forth in claim 4 including:

rigid safety rod means extending between said first pair of upright members and between said second pair of upright members; and means for selectively, releasably mounting said rigid safety rod means to said first and second pairs of upright member, respectively.

17. A free weight lifting system comprising:

elongated lifting bar means having upper and lower surfaces and opposed ends for selectively receiving and supporting weights to be lifted and an inboard region to be gripped by the weight lifter;

support means including:

a first pair of spaced apart upright members positioned in a first plane, said first pair including a fore upright member and an aft upright member; and a second pair of spaced apart upright members positioned in a second plane, said first pair including a fore upright member and an aft upright member, said first and second planes being spaced apart and generally parallel; and yieldable means mounted on said support means, said yieldable means including:

upper pulley means rotatably mounted on each of said aft upright members;

lower pulley means rotatably mounted on each of said aft upright members;

first and second elongate cord means each extending between proximal and distal ends and intermediate said proximal ends being operably engaged with an associated one of said pulley means, said proximal end being attached to an associated one of said fore upright members, said distal end being attached to an associated platform for receiving a plurality of weights thereon;

said cord means being engageable with said lower pulleys only when said lower surfaces of said lifting bar are caused to engage said cord means; and said cord means engageable with both said upper and lower pulleys when said upper surfaces of said lifting bar are caused to engage said cord means;

said cord means being selectively engageable in one instance by said upper surface of said elongated lifting bar at spaced locations for imparting progressively increasing resistance to the weight lifter as said lifting bar means is raised by the weight lifter;

said cord means being selectively engageable in another instance by said lower surface of said elongated lifting bar at spaced locations for imparting progressively increasing assistance to the weight lifter as said lifting bar means is lowered by the weight lifter.

18. A free weight lifting system as set forth in claim 17 wherein said lifting bar means includes:

rolling means engageable with said cord means for minimizing the effect of friction between said cord means and said lifting bar means when engagement occurs.

19. A free weight lifting system as set forth in claim 17 wherein said support means includes:

width adjustment means for selectively adjusting the separation between said first and second planes; and length adjustment means for selectively adjusting the separation between said first and second pairs of upright members.

20. A free weight lifting system as set forth in claim 17 including:

means for adjusting the height of said elongate yieldable means.

* * * * *